United States Patent [19]

Johnson, Jr.

[11] 4,371,206

[45] Feb. 1, 1983

[54] ROCKABLE INFANT SEAT/CRADLE

[75] Inventor: Edward M. Johnson, Jr., Matteson, Ill.

[73] Assignee: Kolcraft Products, Inc., Chicago, Ill.

[21] Appl. No.: 235,148

[22] Filed: Feb. 17, 1981

[51] Int. Cl.[3] ..... A47C 1/02; A47C 3/03; A47D 13/10

[52] U.S. Cl. ..... 297/183; 297/270; 297/364; 297/377

[58] Field of Search ..... 297/183, 258, 270, 377, 297/373, 363–365; 5/106, 105, 101

[56] References Cited

U.S. PATENT DOCUMENTS

| | | | |
|---|---|---|---|
| 3,409,325 | 11/1968 | Hamilton et al. | 297/377 |
| 3,731,342 | 5/1973 | Cousin | 297/365 |
| 3,804,459 | 4/1974 | Nose | 297/377 X |
| 4,324,432 | 4/1982 | Eldon et al. | 297/377 |

*Primary Examiner*—William E. Lyddane
*Attorney, Agent, or Firm*—Ronald A. Sandler

[57] ABSTRACT

A rockable infant seat/cradle includes a rotatably positionable handle secured to the opposed side walls of an integrally molded infant supporting shell. The shell comprises a curved underbelly, oppositely disposed side walls extending transverse to the underbelly and apertured rocker panel walls integral with and spaced outwardly of the side walls. A mechanism, secured to opposed, distal ends of the handle, extends through the apertures in each rocker panel and is adapted to normally lock the handle in any one of a plurality of positions. The handle locking mechanism includes a gear having a plurality of axially extending teeth, a gear retaining ring having a plurality of apertures through which the gear teeth normally extend, and a coil spring which normally biases the gear teeth into a gear ring aperture-engaging condition. The mechanism is responsive to selective axial pressure to space the gear teeth axially of the gear ring apertures so that the handle may be rotated to any one of the plurality of positions.

6 Claims, 6 Drawing Figures

ROCKABLE INFANT SEAT/CRADLE

FIELD OF THE INVENTION

This invention relates generally to infant carriers, and more particularly, to a rockable infant seat/cradle having a releasable, lockable, multi-positionable handle.

BACKGROUND OF THE INVENTION

Various types of baby carriers which include pivotable support members for positioning the carrier in one of several possible positions have been designed. Examples of such carriers are U.S. Pat. Nos. 1,274,458; 3,409,325; 3,804,459; and 3,976,328. Typically the carriers include unnecessarily complicated mechanisms for adjusting the position of the support members. And with any complicated device, the support position adjusting mechanisms are overly prone to failure and expensive to repair.

It is therefore one object of the present invention to provide a rockable infant seat/cradle which includes a simple, yet dependable, mechanism for locking the support member thereof in any one of a plurality of positions.

It should be evident that sharp edges, pointed corners, or other objects protruding from the surface of the body carrier present potential hazards to the infant supported therein. However, the support position adjusting mechanisms of prior art devices include such protruding nuts, bolts, gear teeth or other potentially dangerous metallic hardware.

It is a further object of the present invention to provide a rockable infant seat/cradle which includes a simple, reliable mechanism for locking the support member thereof in one of its plurality of positions, which is formed of a synthetic plastic resin, and which has no exposed metallic hardware.

Other features of this invention will be readily appreciated and the same will become better understood by reference to the following detailed description when considered in connection with the accompanying drawings, in which like reference numerals designate like parts throughout the figures thereof.

BRIEF SUMMARY OF THE INVENTION

There is disclosed herein a rockable infant seat/cradle which includes a multi-positionable, U-shaped handle secured to the opposite sides of an infant receiving and supporting shell. The shell is an integrally molded member which includes an elongated, curved underbelly, transversely extending side walls, apertured, smoothly curved rocker panels formed integrally with and spaced outwardly of the side walls, and a mechanism for adjusting and locking the handle into any one of a plurality of positions.

The handle locking mechanism comprises a gear having a plurality of axially extending and equa-angularly spaced teeth, a gear-retaining ring adapted to be positioned within each of the rocker panel apertures and affixed to each of the opposed side walls of the shell and including a plurality of equa-angularly spaced apertures through which the gear teeth normally extend, and a coil spring which normally biases the gear teeth in a gear ring aperture engaging position. Preferably sixteen gear teeth and sixteen gear ring apertures are provided so that the handle may be rotated and locked into any one of sixteen positions.

Selective, axially inward pressure applied at the opposite distal ends of the legs of the U-shaped handle acts against the bias of the coil spring to space the teeth of the gear from the apertures in the gear-retaining ring so that the handle may be rotated to any one of its sixteen possible positions. After the handle has been rotated into the desired rotational orientation, the pressure is released, thereby allowing the force of the coil spring to return the gear teeth into the gear ring apertures to lock the handle into said newly selected position.

DETAILED DESCRIPTION OF THE DRAWINGS

Figure 1:
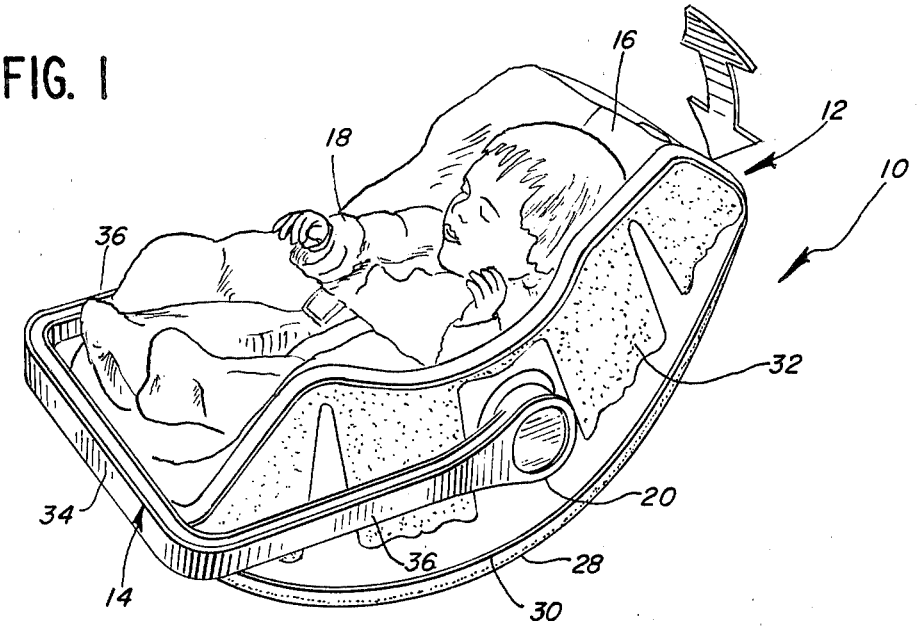
FIG. 1 is a perspective view showing the rockable infant seat/cradle of the present invention in a rocking position.
Figure 2:
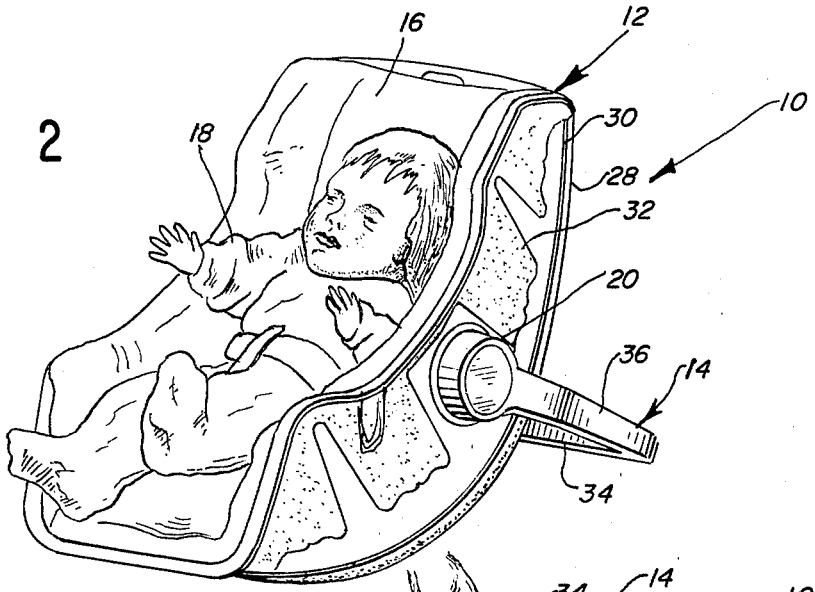
FIG. 2 is a perspective view of the rockable infant seat/cradle of FIG. 1 showing the seat/cradle in a seating position.
Figure 3:
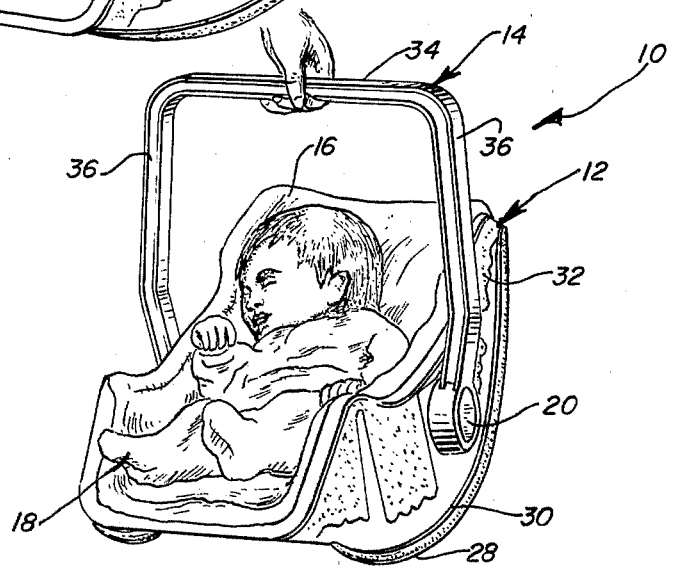
FIG. 3 is a perspective view of the rockable infant seat/cradle of FIG. 1 showing the seat/cradle in a carrying position.
Figure 4:
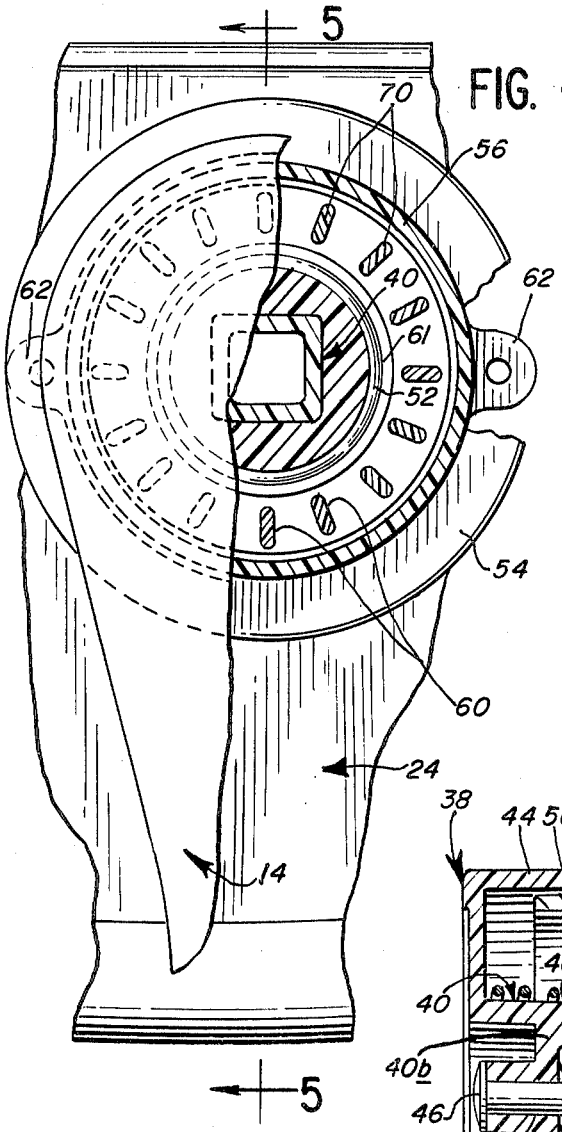
FIG. 4 is a fragmentary side elevational view of the rockable infant seat/cradle of FIG. 1 partially broken-away to show the handle position locking mechanism operatively secured to the handle.
Figure 6:
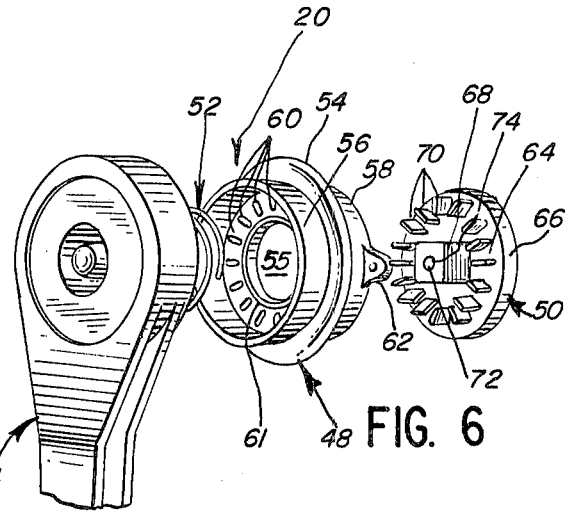
FIG. 6 is an exploded perspective view illustrating the relative location of the handle, the coil spring, the gear-retaining ring, and the gear which cooperate to lock the handle of the infant seat/cradle into any one of a plurality of positions.

Referring now to the drawings and particularly to FIGS. 1–3, the multi-positionable, rockable infant seat/cradle is indicated generally by the reference numeral 10. The infant seat/cradle 10 includes an infant receiving and supporting shell 12, a generally U-shaped carrying and supporting handle 14, a soft, resilient shell liner 16 for padding the interior of the shell 12 for an infant, such as 18, and a mechanism 20 located on each side and interiorly of the handle 14 for locking the handle 14 in any one of a plurality of positions, such as the infant rocking position of FIG. 1, the infant supporting position of FIG. 2, and the infant carrying position of FIG. 3.

Figure 5:
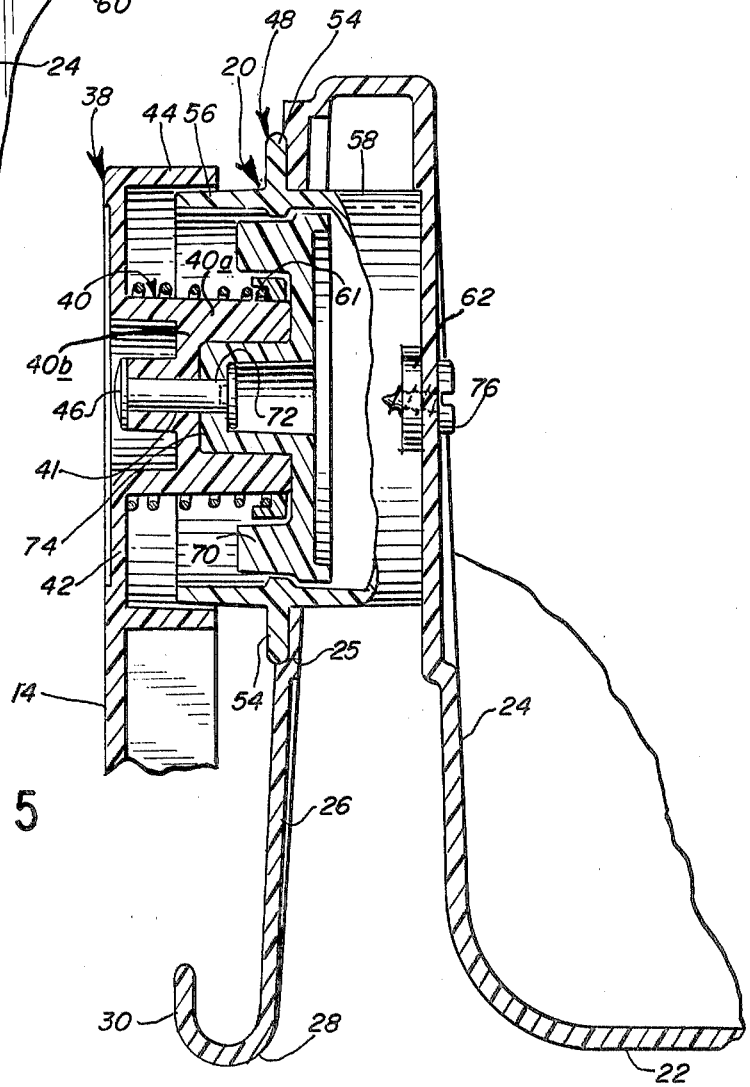
FIG. 5 is a cross-sectional view taken along line 5—5 of FIG. 4 illustrating the handle and the handle position locking mechanism operatively secured to the rockable infant seat/cradle.

The infant receiving and supporting shell 12 is a unitary, plastic molded member having a smooth, convexly curved underbelly 22 (see FIG. 5), a pair of opposed substantially identical side walls 24, which extend transversely to the underbelly 22 of the shell 12, and a pair of rocker panels 26 integrally formed from a downwardly curved portion of each of the side walls 24. Each of the rocker panels 26 includes a through bore 25 for rotatably securing the handle 14 to the side wall 24 as more fully explained hereinafter. The bottom surface 28 of the rocker panels 26 may be curved upwardly to form an upwardly extending flange 30. The rocker panels 26 extend downwardly a distance greater than the lowermost downward extent of the underbelly 22 so that the infant seat/cradle 10 is supported by and adapted to rock along the smoothly and gently curved lowermost surface 30 of the rocker panels 26. The outer surface of the rocker panels 26 may be sculptured as at 32 (see FIGS. 1–3) for aesthetic reasons.

The U-shaped handle 14 includes a bight portion 34 and spaced, integrally formed, substantially identical, generally parallel legs 36. The bight portion 34 and the legs 36 are generally I-shaped in cross-sectional configuration for rigidification thereof. The distal end of each of the legs 36 forms a circularly-shaped, retainer-mating area, generally 38. The retainer-mating area 38 includes a central hub 40 with an axially extending portion 40*a* and a radially extending portion 40*b* with a bore therethrough. A radial web 42 joins the axial hub portion 40*a* with an axially inward extending peripheral flange 44 which surrounds the retainer-mating area 38. The radial hub portion 40*a* is thickened to provide support for a fastening member, such as rivet 46.

The mechanism 20 for locking the handle 14 in any one of a plurality of positions comprises a retaining ring 48, a gear 50, and a coil spring 52. The retaining ring 48 is an integrally molded member which includes a radially extending, apertured ring 54 having a central opening 55, an upper circular wall 56 extending axially from the handle side of the apertured ring 54, and a lower circular wall 58 extending axially from the gear side of the apertured ring 54. Sixteen apertures, such as 60, are equa-angularly spaced about the axis of the ring 54 and extend through the ring 54 radially inward of the circular walls 56 and 58. Although sixteen equally spaced apertures 60 are described as the preferred arrangement, it is to be understood that the number and spacing between apertures may be varied without departing from the spirit and scope of the invention. The inner portion of the central ring 54, immediately radially inward of the apertures 60 is turned axially upward as at 61 for reasons which will become apparent hereinafter. Diametrically opposed portions of the lowermost edge of the circular wall 58 extend radially outward to provide a pair of side wall-attachment flanges 62.

The gear 50 is an integrally formed, generally circular member with a planar disc-like face 64, a radially downwardly extending peripheral skirt 66 which surrounds the face 64, an axially extending central hub 68 and a plurality of gear teeth 70. The central hub 68 can take any irregular shape, but is preferably square-shaped in cross-sectional configuration and includes an aperture 72 through the radial wall 74 thereof. Extending axially from the face 64 of the gear 50 and in a direction opposite of the direction in which the peripheral flange extends are sixteen elongated, equa-angularly spaced, axially and radially extending gear teeth 70. Although each tooth 70 is shown as an axially elongated and generally planar member, the number of teeth, the spacing between teeth and the shape of the teeth may be varied without departing from the spirit and scope of the invention. It is only required that the number of, shape of, and spacing between the gear teeth 70 and the gear ring apertures 60 be substantially identical so that the teeth 70 of the gear 50 can be aligned with and received within the apertures 60 of the gear ring 48.

In an assembled condition, the coil spring 52 is placed about the axial hub portion 40*a* of the retainer-mating area 38 of the handle leg 36. The teeth 70 and the hub 68 of the gear 50 are slipped, respectively, through the apertures 60 and the central opening 55 of the retaining ring 48. The retaining ring 48 with the attached gear 50 is then received by the retainer-mating area 38 of the handle 14 so that the axial and radial walls of the central gear hub 68 are closely surrounded by the axial portion 40*a* and the radial portion 40*b* of the central handle hub 40. The rivet 46 is placed through and affixed to the aligned aperture 72 in the radial gear hub 68 and the bore 41 in the radial handle hub 40. The entire assembly is then inserted through the bores 25 in each of the opposed rocker panels 26. The axial length of the lower circular wall 58 is such as to abut the side wall 24 of the shell 12 when the portion of the central ring 54 of the gear retainer 48, radially outward of the circular wall 58, rests against the rocker panel 26 (in FIG. 5). A pair of self-tapping screws 76 are fastened to the attachment flanges 62 to secure the assembly to the infant seat/cradle 10. When so assembled, the coil spring 50 is compressed between the radial web 42 of the retainer-mating area 38 and the radially inward portion of the central ring 54 of the gear retainer 48. The spring 50 thus normally exerts an axially outward force which urges the handle legs 36 axially outward so that the gear teeth 70 are biased within the apertures 60 in the central ring 54 of the retainer ring 48.

When it is desired to rotate the handle 14 of the infant seat/cradle 10 into a different position, axially inward pressure is applied at the retainer-mating area 38 of each of the legs 36 of the handle 14. The pressure compresses spring 52 and moves the gear teeth 70 axially inward and out of the apertures 60 of the gear retaining ring 48, thus freeing the handle 14 for rotation about the axis of the rocker panel openings 25. After the handle 14 is rotated into the desired position, the application of external pressure is halted. The compressed spring 52 now urges the gear teeth 70 in an axially inward direction to reenter the gear retaining ring apertures 60. If the teeth 70 are not aligned with the apertures 60, slight angulation of the handle 14 will bring the teeth 70 and apertures 60 into alignment at which time the spring 52 forces the teeth 70 through the apertures 60 and locks the handle 14 in that angular position.

While one form of the invention has been described, it will be understood that the invention may be utilized in other forms and environments, so that the purpose of the appended claims is to cover all such forms of devices not disclosed but which embody the invention disclosed herein.

What is claimed and desired to be secured by Letters Patent of the United States is:

1. A rockable infant seat/cradle comprising:

a body-receiving and supporting shell, said shell having an elongated bottom surface and opposed sidewalls, the lowermost edges of said sidewalls being curved along the length thereof to support said shell on an associated support surface while permitting rocking movement thereof relative to such surface;

generally U-shaped handle means having elongated leg portions rotatably secured to opposite sides of said shell;

gear means to effect manual rotation of said handle means to various positions relative to said shell, thereby to permit carrying said shell or to position said shell in rockable or various fixed positions relative to the underlying associated support surface; said gear means including a gear fixedly secured to the distal end of each leg portion of said handle, each said gear having a plurality of axially extending teeth; a gear-retaining ring affixed to the respective opposed sidewall of said shell, said retaining ring including a plurality of axially extending apertures therethrough, through which said gear teeth normally extend, thereby to lock said handle in a fixed position relative to said shell;

and means for normally biasing the respective gears and the handle legs to which said gears are secured in an engaged position wherein the gear teeth extend through the gear ring apertures, the gears being axially displaceable relative to said gear-retaining rings to space the distal ends of said gear teeth axially of the gear ring apertures whereby the handle may be rotated about the axes thereof to permit selective rotatable movement of said handle means relative to said shell.

2. A seat/cradle as in claim 1, wherein the teeth are spaced radially of and equa-angularly about the axis of the gear and extend axially from one side of the gear; and the apertures of the gear-retaining ring are of the same radial and angular spacing as the radial and axial spacing of the teeth of the gear.

3. A seat/cradle as in claim 2, wherein sixteen teeth are provided on the gear and sixteen correspondingly shaped apertures are provided on the ring.

4. A seat/cradle as in claim 1, wherein the distal end of each leg of the handle includes an inwardly extending, non-circularly shaped hub which is rotatably secured to and closely surrounds an outwardly extending, similarly shaped hub of the gear.

5. A seat/cradle as in claim 4, wherein the central opening in the gear-retaining ring is sized to receive therein the inwardly extending hub of the handle.

6. A seat/cradle as in claim 1, wherein the infant receiving and supporting shell further includes opposed rocker panel walls spaced outward of the opposed side walls; the gear retaining ring including a circular wall extending axially from both sides of the central ring, the circular ring wall adapted to extend axially through the rocker panel wall and to abut and be secured to the side wall of the shell, and an inwardly extending handle flange adapted to surround the outwardly extending circular wall of the gear-retaining ring.

* * * * *